United States Patent [19]

Farnham et al.

[11] Patent Number: 4,495,058

[45] Date of Patent: Jan. 22, 1985

[54] PROCESS FOR GENERATING SUPERHEATED STEAM USING RETORTED SOLIDS

[75] Inventors: Robert A. Farnham, San Rafael; Lawrence P. Zestar, Richmond; Corey A. Bertelsen, Oakland, all of Calif.

[73] Assignee: Chevron Research Company, San Francisco, Calif.

[21] Appl. No.: 501,592

[22] Filed: Jun. 6, 1983

[51] Int. Cl.[3] ..... C10G 1/02

[52] U.S. Cl. ..... 208/11 R; 201/16; 201/31

[58] Field of Search ..... 208/11 R; 201/16, 31

[56] References Cited

U.S. PATENT DOCUMENTS

| | | | |
|---|---|---|---|
| 4,149,597 | 4/1979 | Redford | 208/11 R |
| 4,199,432 | 4/1980 | Tamm et al. | 208/11 R |
| 4,332,669 | 6/1982 | Spars et al. | 208/11 R |
| 4,336,128 | 6/1982 | Tamm | 208/11 R |

*Primary Examiner*—Delbert E. Gantz
*Assistant Examiner*—Anthony McFarlane
*Attorney, Agent, or Firm*—S. R. LaPaglia; W. K. Turner; D. P. Freyberg

[57] ABSTRACT

Superheated steam generated by passing wet steam through a superheater containing a fluidized or partially fluidized bed of hot particulate solids recovered from a retorting process especially useful in a process for recovering hydrocarbon vapors from a hydrocarbonaceous solid such as oil shale.

12 Claims, 1 Drawing Figure

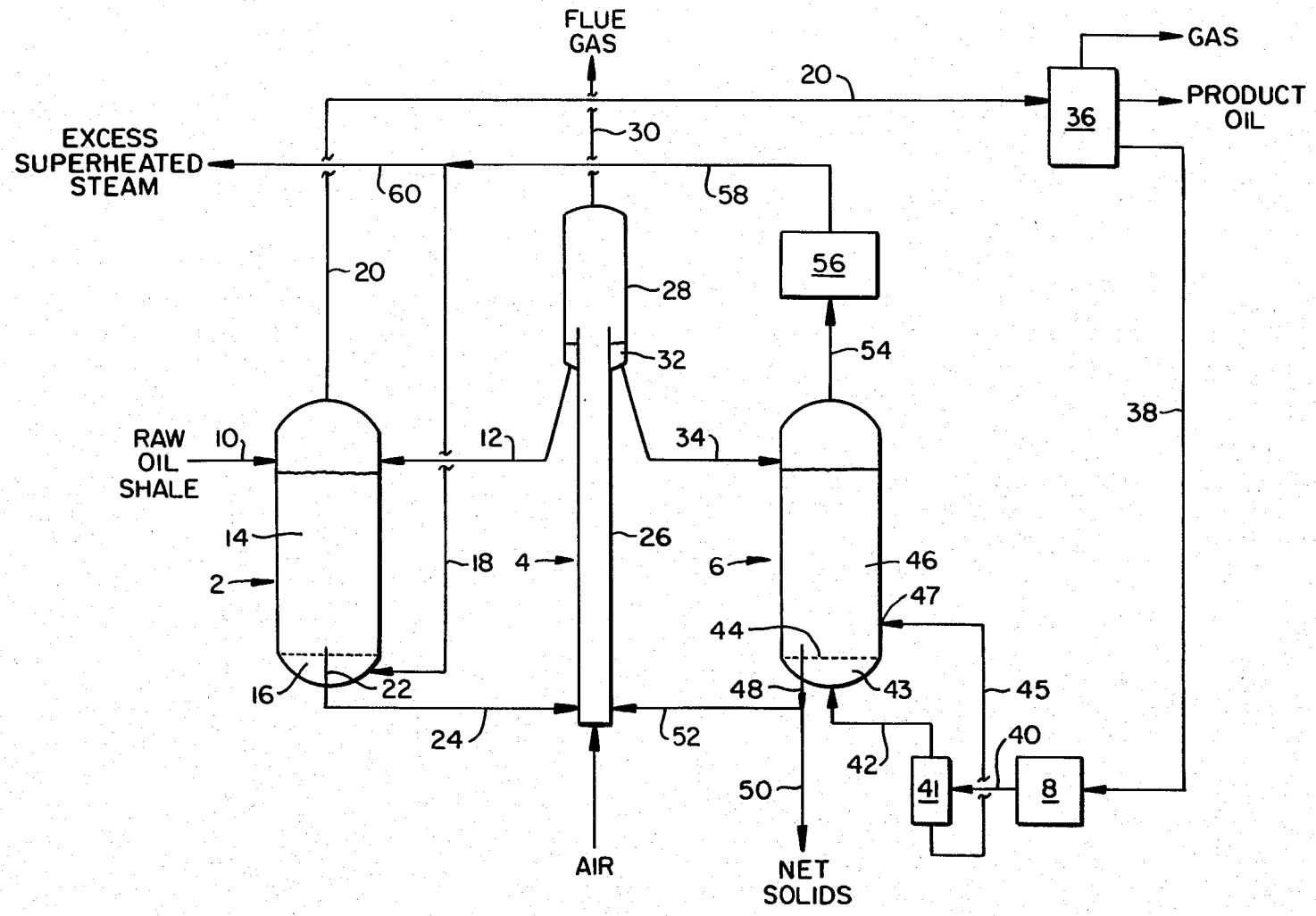
GAS
PRODUCT OIL
36
38
8
45
40
41
46
47
43
42
56
54
20
58
28
32
34
6
44
48
50
NET SOLIDS
52
FLUE GAS
30
26
AIR
4
12
18
24
60
20
22
16
14
10
2
RAW OIL SHALE
EXCESS SUPERHEATED STEAM

PROCESS FOR GENERATING SUPERHEATED STEAM USING RETORTED SOLIDS

BACKGROUND OF THE INVENTION

Certain naturally occurring materials such as oil shale, tar sands, and diactomaceous earth contain a hydrocarbonaceous component which upon heating releases volatile hydrocarbon vapors. Various methods for retorting these materials to produce the pyrolysis vapor have been described. See for example U.S. Pat. Nos. 4,199,432; 4,312,740; 3,008,894; and 3,703,442. In many of these process schemes an inert gas, i.e., a non-oxidizing gas, is used in the retort or in some other step of the process. Superheated steam is often a preferred gas for this purpose.

The use of superheated steam in a retorting process presents several problems which must be overcome if it is to be used in a commercial synthetic petroleum process. In areas where the raw materials are normally found, water for producing the steam is usually not readily available due to the arid climate. This makes recycling of the process steam condensate essential. However, contamination of the steam condensate and process water with salts as a result of the process usually requires expensive cleanup steps before the combined water can be recycled. Otherwise, the accumulation of salts in the pipes and steamtubes will result in equipment failures.

The present process involves a means for preparing superheated steam from recycled steam condensate and process water of variable quality while avoiding equipment fouling.

SUMMARY OF THE INVENTION

The present invention is concerned with a process for generating superheated steam as part of a retorting process involving a particulate solid which comprises:

(a) recovering a hot particulate solid from the retorting process;

(b) introducing the hot particulate solid into a steam superheater to form a bed of solids therein;

(c) passing wet steam through the bed of hot particulate solids at a velocity sufficient to at least partially fluidize the hot particulate solids, and providing sufficient residence time in the bed to superheat the steam; and (d) withdrawing superheated steam from the steam superheater.

As used herein the term "superheated steam" refers to steam heated to a temperature above the saturation temperature at a given pressure. Wet steam refers to steam containing free water. Wet steam is usually referred to as having a quality of less than 100% (superheated steam will always be high quality steam, i.e., 100% quality).

The process is particularly useful with processes for retorting a hydrocarbonaceous solid such as oil shale, tar sand, or diatomaceous earth. The hot particulate solids used to form the bed of solids in the superheater may be retorted hydrocarbonaceous feed, combusted retorted solids, heat transfer solids, etc. Such materials would include retorted oil shale, burned oil shale, sand, ceramic materials, crushed rock, steel, and the like. The hot particulate solid employed in the superheater is preferably a by-product of the retorting process and is readily available for use in producing the superheated steam. Since the retorting of such materials generally requires a temperature in excess of 850° F., the hot solids recovered from the retorting process and used in the invention will have a temperature suitable for superheating the wet steam. Usually the superheated steam will be heated by the superheater to a temperature of from about 300° F. to about 1500° F.

BRIEF DESCRIPTION OF THE DRAWING

The FIGURE is a diagrammatic representation of a process scheme for producing superheated steam from burned retorted oil shale using an indirectly heated retort with a cumbustor.

DETAILED DESCRIPTION OF THE DRAWING

The present invention will be more clearly understood by reference to the drawing. Shown is a process for retorting oil shale, in which burned retorted shale is used to superheat wet steam. Major components of the process scheme include a retorting vessel 2, a liftpipe combustor 4, a steam superheater 6, and a steam generator 8.

In operation, particulate oil shale enters the retort 2 via raw feed inlet 10 where it is mixed with hot particulate heat transfer solids introduced into the retort via recycle conduit 12. In the retort, the mixture of raw oil shale and heat transfer material forms a vertical downward moving bed of solids 14. In the process scheme illustrated, superheated steam is used as a stripping gas in the retort to aid in carrying away the pyrolysis vapors. The superheated steam is introduced into the bottom of the retort through plenum chamber 16 and steam conduit 18. The superheated steam and pyrolysis vapors pass out of the retort via gas recovery conduit 20. The mixture of pyrolyzed shale and heat transfer material is withdrawn from the bottom of the retort via drawpipe 22 and sent via conduit 24 to the lower end of the combustor 4. Retorting schemes, such as shown in the drawing, are usually referred to as indirectly heated retorts.

In the bottom of the liftpipe 26 of the combustor 4, the solids are entrained in a stream of air which carries the particles up the length of the liftpipe. During passage up the liftpipe 26, the carbonaceous residue which remains in the oil shale following retorting is ignited and burned to provide heat for the process. The upper section 28 of the combustor serves as a disengaging zone and solids collection area. Flue gas is removed via flue gas outlet 30. Hot solids at a temperature of about 1000° F. to 1400° F. are collected in a bed 32 in the bottom of the upper section 28 of the combustor. The hot solids in bed 32 may be recycled to the retort as heat transfer solids via recycle conduit 12 or sent to the superheater 6 via conduit 34.

Returning to the retort 2, pyrolysis vapors and stripping gas (steam) are carried by gas recovery conduit 20 to a product spearation and recovery zone 36. In the product separation and recovery zone condensable hydrocarbons are separated from non-condensable gases. In addition, the steam is condensed and recovered as water by water recycle pipe 38. The recovered water is sent to the steam generator 8 where it is converted into low quality or wet steam. The steam generator may be a conventional boiler or other device suitable for producing low quality steam. The wet steam is carried by conduit 40 to a steam separator 41 which separates saturated steam, i.e., 100% quality steam at its dew point, from wet steam, i.e., steam of less than 100% quality. The saturated steam passes via conduit 42 to plenum chamber 43 of the superheater. The saturated steam passes through the grid gas distributor 44 and up through the bed of hot particulate solids 46 formed by the burned oil shale entering the top of the superheater via conduit 34. The wet steam is carried from the steam separator 41 by conduit 45 for injection into the superheater by side nozzles located at point 47. The wet steam is introduced separately from the saturated steam to prevent "hammering" in the superheater. The steam should enter the bed at a velocity sufficient to at least partially fliuidize the solids in the bed. As the steam traverses the bed of solids, it will acquire heat from the particles in the bed. The steam should have a residence time in the bed sufficient to raise its temperature above the saturation point at the pressure prevailing in the superheater. Preferably, the residence time will be sufficient to reach thermal equilibrium with the hot solids.

The solids in the bed are withdrawn from the superheater by drawpipe 48. Excess solids may be discarded via conduit 50. Solids needed for recycling are returned to the combustor via conduit 52 for reheating.

The superheated steam at a temperature between about 300° F. to 1500° F. leaves the top of the bed 46 and exits the superheater by steam exhaust pipe 54. Since in passing through the bed of solids fine particles may become entrained in the steam, the superheated steam is passed through a fines removal zone 56. This zone may consist of a cyclone, filter, or other device suitable for removal of fine suspended solids from a gas stream. The superheated steam, free of particulates, is carried by conduit 58 back to steam conduit 18 for recycle as a stripping gas in the retort. Alternately, excess superheated steam is drawn off from the system by conduit 60.

The process of superheating steam, described above, avoids the problem of dissolved salts that would foul conventional superheaters in the absence of additional treatment steps. In the process the dissolved salts will be precipitated out of the steam onto the burned shale in the superheater. Since this material is being constantly circulated through the superheater, there is no accumulation of fouling in the superheater itself. The high quality steam leaving the superheater is shown in the diagram as being recycled to the retort as stripping gas. One skilled in the art will recognize that the steam may be used for other purposes as well. For example, the superheated steam may be used to generate electricity. For some applications it may be desirable to pass the low quality feed water through an ammonia/hydrogen sulfide stripper prior to feeding to the steam generator. However, when the steam is being recycled into the retorting process such supplemental treatment is usually not necessary.

While the process described above is one preferred way of carrying out the invention, other solids besides those collected from the combustor may be used to heat the low quality steam. For example, hot retorted solids collected directly from the retort may be used in the superheater. While these solids are usually at a lower temperature than the solids from the combustor, under some circumstances this may be desirable.

The type of retort employed to pyrolyze the raw feed is not a critical limitation on the process. Thus, the retort may employ a screw mixer, fluidized bed, packed bed, etc., to effect pyrolysis of the raw feed. The staged turbulent bed is a particularly preferred method for retorting hydrocarbonaceous solids. See. U.S. Pat. No. 4,199,432. While it is generally desirable that a heat transfer solid be circulated between a retort and a combustor, other modes of operation are known to the art and may be used to retort the solid. Thus, directly heated retorting systems such as, for example, the Paraho retorting system, also may be used to provide the hot solids required for the superheater. The only critical limitation is that the retorting system chosen provide sufficient hot solids in a size range suitable for fluidization in the superheater.

The retorting of other materials besides oil shale may be carried out in a similar manner to that described above. One skilled in the art will recognize that some modifications may be required in the process to use other materials such as tar sand or diatomaceous earth in carrying out the invention.

In general, a fluidized bed or partially fluidized bed is the most efficient means for promoting thermal transfer between a solid and a gas. Therefore, such systems are preferred in contacting the gas and solid in the superheater. As used herein fluidization of the particles in the bed occurs when the upward flow of steam through the interstices of the bed attains a frictional resistance equal to the weight of the bed. It should also be understood that as the steam rises through the bed it will acquire heat; thus, causing an expansion in the volume of the gas. Thus, the lower portion of the bed in the superheater may experience a lower gas velocity than upper parts of the bed. This may translate into differential expansion of the bed depending upon the design of the vessel.

In one particularly preferred embodiment of the invention the superheater comprises a vertical vessel as illustrated in the drawing but containing internal baffles or other distribution means for controlling the movement of solids and gases through the superheater. Horizontal perforated trays having from about 30% to about 70% open area are a suitable design for carrying out this aspect of the invention. The internals should be designed and disposed to control gross vertical backmixing and slugging of the solids passing downward through the superheater. At the same time the internals control the bubble size of the gas (steam) passing up the superheater countercurrent to the flow of the solids. Such a design for controlling the movement of solids and gases in countercurrent flow relative to one another is referred to as a staged turbulent bed. A detailed discussion of the design of such a bed is discussed in U.S. Pat. No. 4,337,120 herein incorporated by reference.

What is claimed is:

1. A process for retorting particulate oil shale, which comprises:

(a) passing superheated steam through a bed comprising a mixture of the oil shale and hot combusted shale in a retort at a pyrolyzing temperature to recover a gaseous mixture of product vapors and steam and to separately recover a solid mixture of pyrolyzed shale and the combusted shale;

(b) condensing the steam in the gaseous mixture to recover water separately from the product vapors;

(c) heating the water in a steam generator to produce steam;

(d) passing the steam through a steam separator to separate the steam into wet steam and saturated steam;

(e) burning the solid mixture in a combustor to recover hot combusted shale;

(f) recirculating a first portion of the hot combusted shale to the retort;

(g) introducing a second portion of the hot combusted shale to a steam superheater to form a bed of solids therein;

(h) introducing the saturated steam into the bed of hot combusted shale solids in the superheater through the bottom of the bed at a rate sufficient to at least partially fluidize the solids in the bed and introducing the wet steam into the bed at a point above the bottom of the bed and further providing sufficient residence time for the steam in the bed to superheat the steam;

(i) recirculating at least a portion of the superheated steam to the retort; and (j) recirculating the shale solids from the superheater to the combustor.

2. The process of claim 1 wherein the retort employs a staged turbulent bed.

3. The process of claim 1 wherein the supereheater employs a staged turbulent bed containing internal distribution means for limiting gross vertical backmixing of the solids in the superheater.

4. The process of claim 3 wherein the retort employs a staged turbulent bed.

5. A process for generating superheated steam as part of a retorting process for a hydrocarbonaceous solid which comprises:

(a) passing superheated steam through a bed of hydrocarbonaceous solids at a pyrolyzing temperature in a retort to recover a gaseous mixture of product vapors and steam, and to recover separately hot particulate retorted solids;

(b) introducing the hot particulate retorted solids into a steam superheater to form a bed of solids therein;

(c) condensing the steam in the gaseous mixture to recover water separately from the product vapors;

(d) heating the water in a steam generator to produce steam;

(e) passing the steam through a steam separator whereby the steam is divided into saturated steam and wet steam;

(f) introducing the saturated steam into the bed of hot particulate retorted solids in the superheater through the bottom of the bed at a rate sufficient to at least partially fluidize the solids in the bed and introducing the wet steam into the bed at a point above the bottom of the bed and further providing sufficient residence time for the steam in the bed to superheat the steam; and (g) recirculating the superheated steam to the retort.

6. The process of claim 5 wherein the hot particulate retorted solids are burned in a separate combustor prior to introduction into the superheater.

7. The process of claim 5 wherein the hot particulate solids in the superheater are recovered from a directly heated retort.

8. The process of claim 5 wherein the hot particulate solids in the superheater have a temperature of at least 850° F.

9. The process of claim 8 wherein the steam in the superheater is raised to a temperature between 300° F. and 1500° F.

10. The process of claim 5 wherein the retort employs a staged turbulent bed.

11. The process of claim 5 wherein the particulate hydrocarbonaceous solid being retorted is oil shale.

12. The process of claim 5 wherein the superheater employs a staged turbulent bed containing internal distribution means for controlling gross vertical backmixing of solids in the superheater.

* * * * *

UNITED STATES PATENT AND TRADEMARK OFFICE

CERTIFICATE OF CORRECTION

PATENT NO. : USP 4,495,058

DATED : January 22, 1985

INVENTOR(S) : Robert A. Farnham et al

It is certified that error appears in the above-identified patent and that said Letters Patent are hereby corrected as shown below:

Col. 2, line 56, "spearation" should read --separation--.

Col. 5, Claim 3, line 1, "supereheater" should read --superheater--.

Signed and Sealed this

*Eighteenth* Day of *June 1985*

[SEAL]

*Attest:*

DONALD J. QUIGG

*Attesting Officer* *Acting Commissioner of Patents and Trademarks*